US005564968A

United States Patent [19]

Werner

[11] Patent Number: 5,564,968

[45] Date of Patent: Oct. 15, 1996

[54] ANTI-CHATTERING HONING TOOL WITH SELECTABLE STONES

[75] Inventor: Wilfred M. Werner, Covina, Calif.

[73] Assignee: B W & C, Inc., Covina, Calif.

[21] Appl. No.: 418,591

[22] Filed: Apr. 6, 1995

[51] Int. Cl.[6] ..... B24B 25/00; B24B 9/02

[52] U.S. Cl. ..... 451/67; 451/462; 451/479; 451/483

[58] Field of Search ..... 451/65, 67, 462, 451/464, 479, 482, 483, 487

[56] References Cited

U.S. PATENT DOCUMENTS

| | | | |
|---|---|---|---|
| 1,926,835 | 9/1933 | Cook | 451/482 X |
| 1,982,836 | 12/1934 | Sunnen | 451/482 X |
| 2,023,082 | 12/1935 | Kern et al. | 451/483 X |
| 2,063,931 | 12/1936 | Hutto | 451/479 X |
| 2,421,470 | 6/1947 | Sunnen . | |
| 2,627,707 | 2/1953 | Brooks | 451/483 |
| 3,216,155 | 11/1965 | Sunnen | 451/479 |
| 3,561,172 | 2/1971 | Werner . | |
| 3,624,693 | 11/1971 | Werner . | |
| 5,243,792 | 9/1993 | Vanderwal, Jr. | 451/483 |

*Primary Examiner*—Timothy V. Eley
*Attorney, Agent, or Firm*—Fred N. Schwend

[57] ABSTRACT

A honing tool comprises an hexagonally shaped mandrel having a cylindrical bore extending centrally therethrough. Six similar tool holders are each provided with a pair of spaced cylindrical gear racks having rack gear teeth formed thereon and integrally attached to an elongate tool support. A metal tool carrier to which is suitably bonded a tool, such as an abrasive cutting stone or a wiper is removably attached to a respective tool support by a clamp screw. The gear racks of each tool holder are slidably mounted in respective bearings holes in the mandrel. Gear teeth on the racks mesh with gear teeth formed on a splined shaft rotatably mounted in the mandrel bore. Thus, rotation of the shaft counter-clockwise relative to the mandrel extend all of the tools outwardly to extended positions.

9 Claims, 2 Drawing Sheets

ANTI-CHATTERING HONING TOOL WITH SELECTABLE STONES

BACKGROUND OF THE INVENTION

Field of the Invention

This invention relates to tools for honing, lapping, and/or grinding and has particular reference to honing, etc. tools having radially adjustable abrasive stones for finishing the internal cylindrical surfaces of workpieces, such as the cylinders of engine blocks, hydraulic actuators and the like.

SUMMARY OF THE INVENTION

Generally, heretofore, honing tools of the above type incorporated two diametrically opposed stones, which are adjusted radially outward to engage an interior cylindrical surface to be honed. Although such hones are generally satisfactory, when honing out-of-round surfaces, they tend to alternately wipe across high spots in the surface and then miss low spots, thus inducing vibration or chatter which tends to break down the stones and produce "chatter marks" in the surface. Accordingly, the honing speed must be reduced considerably and in many cases chattering occurs regardless of the honing speed.

I have discovered, particularly when honing roughened or somewhat out-of-round cylindrical surfaces, that by arranging three abrasive stones 120 degrees apart about the axis of the tool, with intermediate wiping shoes, the most efficient and accurate finishing results may be obtained, while enabling a maximum radial adjustment of the stones for different cylinder diameters. Such arrangement of stones with three equi-spaced points of engagement insures that at least one stone is in wiping engagement with the workpiece surface at all times to reduce any chattering tendencies and to enable higher honing speeds.

It therefore becomes a principal object of the present invention to provide a new and improved honing tool to accurately finish a cylinder bore even though the latter may be rough or out-of-round.

Another object is to provide an improved honing tool of the above type which effectively reduces chattering or vibration during a honing operation.

Another object is to increase the honing speed of a honing tool of the above type.

Another object is to provide a honing tool of the above type with two sets of stones of different abrasive characteristics with means for readily placing one or the other set in operating condition.

An other object is to provide a honing tool of the above type with a set of roughening stones and a set of finishing stones with means for selectively setting one or the other set in operating condition without having to dismantle the tool or remove it from operating relation with a cylinder surface being honed.

A further object is to provide a simple and reliable honing tool which is inexpensive to manufacture and assemble.

BRIEF DESCRIPTION OF THE DRAWINGS

The manner in which the above and other objects are accomplished will be readily understood on reference to the following specification when read in conjunction with the accompanying drawing, wherein.

DESCRIPTION OF THE PREFERRED EMBODIMENT

Figure 1:
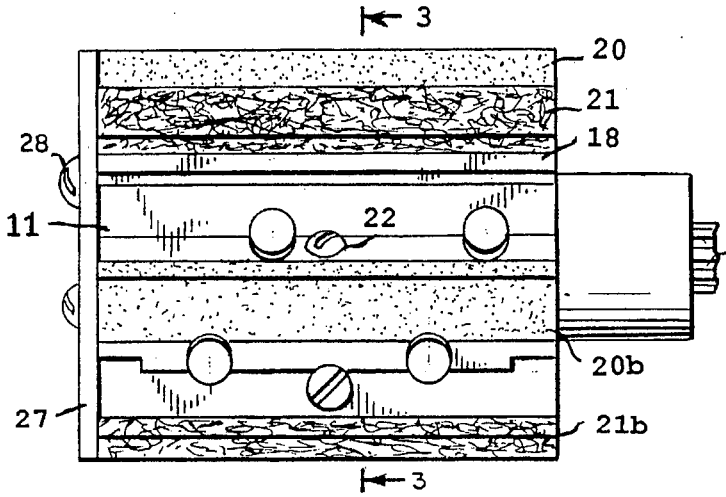
FIG. 1 is a side view of a honing tool embodying a preferred form of the present invention and is taken in the direction of the arrow 1 in FIG. 3.

While this invention can be embodied in many different forms, there is shown in the drawings a preferred and a modified form, but it should be understood that the present disclosure is to be considered only as an exemplification of the principles of the invention and is not intended to limit the invention to the embodiments illustrated. The scope of the invention will be pointed out in the appended claims.

Referring in particular to FIGS. 1 to 4, the honing tool shown therein comprises a hexagonally shaped mandrel 11 having a cylindrical bore 12 extending centrally therethrough.

Six similar tool holders generally indicated at 13, (see FIG. 4 in particular) are each provided with a pair of spaced cylindrical gear racks 14 and 15 having rack gear teeth 16 formed thereon and integrally attached to an elongate tool support 17. A metal tool carrier 18 to which is suitably bonded a tool, such as an abrasive cutting stone 20 or a wiper 21 (FIG. 3) of relatively soft fibrous material, such as felt, is removably attached to a respective tool support 17 by a clamp screw 22.

The gear racks 14 and 15 of each tool holder 13 are slidably mounted in respective bearing holes, i.e., 23, in the mandrel 11. Such holes are located on opposite sides of the bore 12 and open into the latter. Gear teeth 16 on the racks mesh with gear teeth formed on a splined shaft 24 rotatably mounted in the mandrel bore 12. Thus, rotation of the shaft 24 counterclockwise from its position shown on FIG. 3 relative to the mandrel will extend all of the tools, i.e., 20 and 21, outwardly to extended positions indicated as an example by the dot-dash lines 20' of FIG. 3.

To limit extension of the tool holders 13 beyond their outer positions, i.e., 20', the lowermost tooth 25 of at least one of the gear racks 14 and 15 is enlarged slightly so as to jam against a tooth of shaft 24 preventing further rotating of the shaft in a conterclockwise direction. This will prevent the tool holders from flying outward from the mandrel 11 with disastrous results in the event the mandrel should be rotated when not involved in a honing operation.

It will be noted that the various tools 20 and 21 are aligned endwise with the mandrel but that the gear racks, i.e., 14 and 15, are located at different distances from either end of the mandrel so that they will not interfere with each other while insuring parallel movement of the various tools.

In accordance with the present invention, the three stones 20, **20*a* and 20*b*** are angularly located 120 degrees apart from each other. Therefore, during a honing operation, at least one stone will always engage a portion of the cylindrical surface being honed even though the latter may be somewhat oval or otherwise out-of-round. Accordingly, there will be a continual drag or resistance to rotation of the mandrel which will obviate any tendency for the stones to chatter or vibrate and thereby develop chatter marks in the honed surface as well as cause undue break-down of the stones. Also, such constant drag will reduce the possibility of the honing tool to freeze or grab against the honed surface with possible damage to the part being honed and injury to the operator.

It will be noted that the three wiper elements 21, 21*a*, 21*b*, are also located 120 degrees apart and intermediate the stones 20. Such wiper elements are extended the same distances as the stones 20 and thus wipe along the surface being honed to remove any particles of metal or stone being removed during the honing operation.

A guard disc 27 is secured to the left end of the mandrel 11 concentrically of the mandrel by screws 28 to prevent the stones or wiper elements from striking obstacles which may be in the path of the honing tool as it is moved along its axis.

DESCRIPTION OF THE MODIFIED EMBODIMENT

Figure 2:
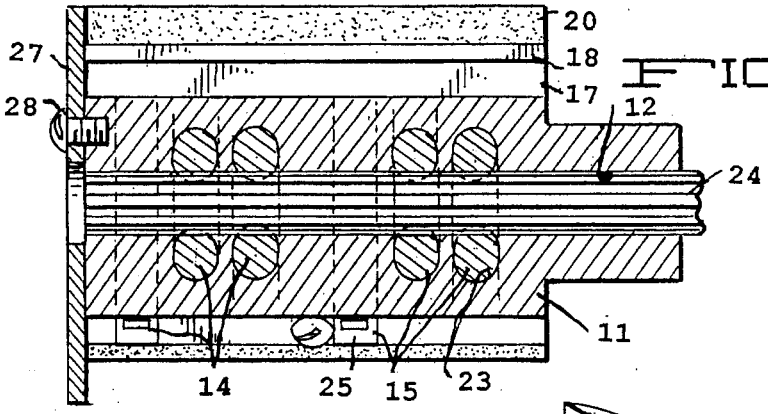
FIG. 2 is a longitudinal sectional view of the honing tool and is taken along line 2—2 of FIG. 3.
Figure 3:
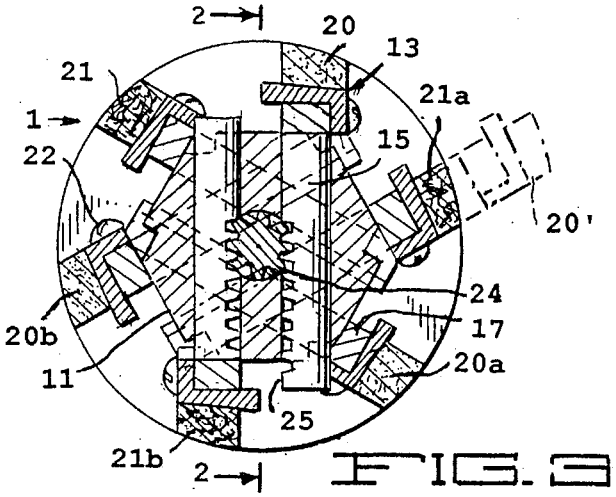
FIG. 3 is a transverse sectional view taken along line 3—3 of FIG. 1.
Figure 4:
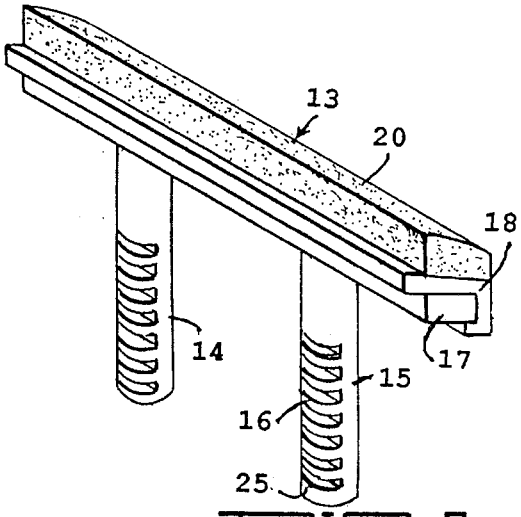
FIG. 4 is a perspective view of one of the stone holders.
Figure 5:
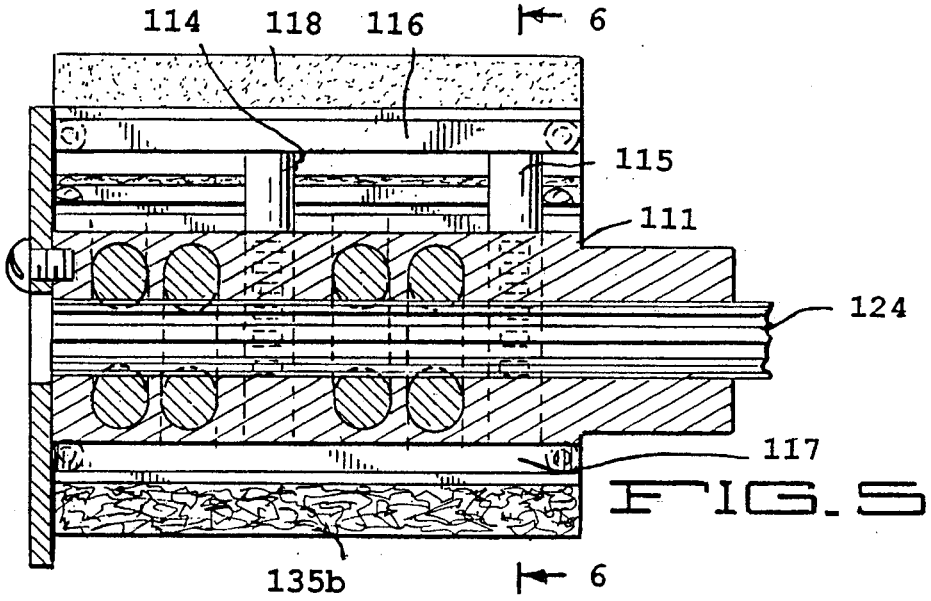
FIG. 5 is a longitudinal sectional view of a modified form of the invention and is taken along line 5—5 of FIG. 6.
Figure 6:
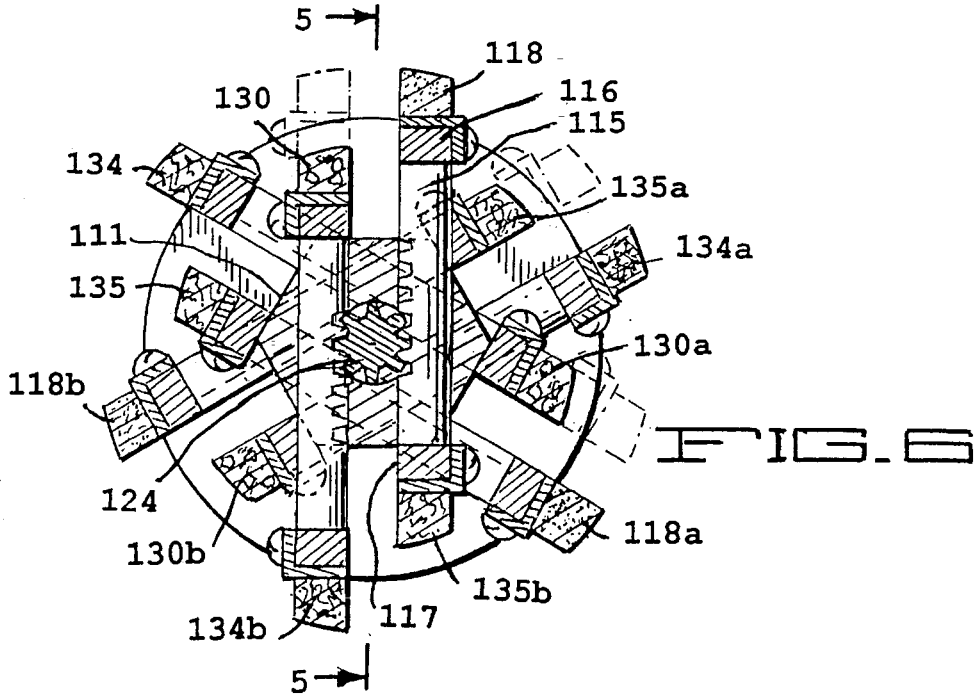
FIG. 6 is a transverse sectional view taken along line 6—6 of FIG. 5.

FIGS. 5 and 6 illustrate a modified form of the invention utilizing a hexagonal mandrel 111 and splined shaft 124 similar to the mandrel 11 and shaft 24 of FIGS. 1 to 3.

In this case, a typical tool support 116, similar to tool support 17, is integrally attached to one end of each of a pair of gear racks 114 and 115, and a second typical tool support 117 is integrally attached to the opposite ends of the gear racks. This is typical of the six illustrated sets of tool supports.

Two sets of stones 118, 118*a*, 118*b* and 130, 130*a*, 130*b* are provided along with two sets of wiper elements 134, 134*a*, 134*b* and 135, 135*a*, 135*b*. Stones 118 to 118*b* are formed of a relatively fine abrasive material and are mounted on tool supports 116 and 117 at locations 120 degrees apart. Similarly, stones 130 to 130*b* are formed of relatively coarse abrasive material and are mounted on tool holders at locations 120 degrees apart and intermediate stones 118 to 118*b*.

The various tool supports 116 and 117 are shown in full lines in FIG. 6 in positions locating the fine stones 118 to 118*b* outwardly in honing locations while the coarse stones 130 to 130*b* are located inwardly out of honing locations.

Similarly, wiper elements 134 to 134*b* are shown in outer wiping locations while wiper elements 135 to 135*b* are located out of wiping locations.

In performing a honing operation, the shaft 124 is typically first rotated clockwise in FIG. 6 relative to the mandrel 111 to extend the three coarse stones 130 to 130*b* outwardly to honing engagement with the cylindrical surface of a work piece, not shown. Concurrently, the wiper elements 135 to 135*b* will also be moved outwardly into wiping engagement with the workpiece surface while the wiper elements 134 to 134*b* will be retracted along with coarse stones 130 to 130*b*.

When, a coarse honing operation is completed, the operator merely rotates the shaft 124 counterclockwise relative to the mandrel 111 to extend the set of three fine stones 118 to 118*b*, along with wiper elements 134 to 134*b*, to honing locations while retracting the coarse stones and accompanying wiper elements.

It will be seen from the foregoing that the honing tool may be readily adjusted for coarse and fine honing operations without having to remove the honing tool from the workpiece or having to dismantle the tool to change the stones.

If desired, stones of equal coarseness may be substituted for the two sets 118 to 118*b* and 130 to 130*b* of the embodiment shown in FIGS. 5 and 6.

In addition, if desired, the wipers 21 to 21*b* of the embodiment shown in FIGS. 1 to 4 and the wipers 134 to 134*b* and 135 to 135*b* of the embodiment shown in FIGS. 5 and 6 may be readily removed from their supports without materially affecting the abrading action of the various stones.

I claim:

1. A honing device comprising a mandrel, a first set of relatively coarse abrasive elements, first means supporting said elements in angularly spaced relation about said mandrel, a second set of relatively fine abrasive elements, second means supporting said second set of elements in angularly spaced relation about said mandrel, and third means for selectively causing said first or said second supporting means to extend said first or said second set outwardly relative to said mandrel.

2. A honing device as defined in claim 1 wherein said elements of said first set are equi-angularly spaced about said mandrel.

3. A honing device as defined in claim 2 wherein said elements of said second set are equi-angularly spaced about said mandrel and equi-angularly spaced from said elements of said first set.

4. A honing device as defined in claim 3 comprising a set of wiper element carriers, and fourth means supporting said wiper element carriers about said mandrel and intermediate said elements.

5. A honing device as defined in claim 4 comprising means for causing said fourth means to extend said wiper element carriers outwardly from said mandrel in unison with elements of said first or second sets.

6. A honing device as defined in claim 1 wherein said elements of said first set are angularly spaced 120 degrees from each other about said mandrel and said second set are angularly spaced 120 degrees from each other about said mandrel.

7. A honing device comprising a mandrel having a bore therethrough, a shaft rotatable in said bore, said shaft having gear teeth therearound, a first set of bearing holes extending through said mandrel and opening into said bore, said holes being angularly spaced 120 degrees about said bore, a second set of bearing holes extending through said mandrel and opening into said bore, said bearing holes of said second set being aligned angularly with said first set and spaced different distances from each other along said bore, a first group of carriers for relatively coarse abrasive elements, each of said carriers comprising a pair of spaced gear racks slidable in respective ones of said holes and meshing with said gear teeth on one side of said shaft, a third set of bearing holes extending through said mandrel and opening into said bore, said third set of bearing holes being spaced angularly about said bore intermediate said first and second set and spaced along said bore and spaced different distances from each other along said bore, a fourth set of bearing holes extending through said mandrel and opening into said bore, said fourth set being aligned angularly with said third set and spaced different distances from each other along said bore, a second group of carriers for relatively fine abrasive elements, each of said second group comprising a pair of spaced gear racks slidable in respective ones of said third and fourth sets of holes and meshing with said gear teeth on the opposite sides of said shaft whereby rotation of said shaft in one direction will move said first group of carriers outward and said second group inwardly and rotation of said shaft in the opposite direction will move said second group outwardly and said first group inwardly.

8. A honing device comprising a mandrel having a bore therethrough, a shaft rotatable in said bore, said shaft having gear teeth therearound, a first set of bearing holes extending through said mandrel and opening into said bore, said holes being angularly spaced apart 120 degrees, a second set of bearing holes extending through said mandrel and opening into said bore, said bearing holes of said second set being aligned angularly with said first set and spaced different distances from each other along said bore, a set of abrasive element carriers, each of said carriers comprising a pair of spaced gear racks slidable in respective ones of said holes and meshing with said gear teeth whereby rotation of said shaft relative to said mandrel will move said carriers outwardly in unison, a third set of bearing holes extending through said mandrel and opening into said bore, said third set of bearing holes being spaced angularly about said bore intermediate said first and second set and spaced along said bore, a fourth set of bearing holes extending through said mandrel, said fourth set being aligned angularly with said third set, said bearing holes of said fourth set being spaced different distances along said bore, a set of three wiper element carriers, and each of said wiper element carriers comprising a pair of spaced gear racks slidable in respective ones of said third and fourth sets of holes and meshing with said gear teeth whereby rotation of said shaft will move said wiper element carriers outwardly in unison with said abrasive element carriers.

9. A honing device as defined in claim 8 wherein said third and fourth sets of bearing holes are angularly spaced midway between said first and second set.

* * * * *